US012709825B2

(12) United States Patent
Aceves Tinajero et al.

(10) Patent No.: US 12,709,825 B2
(45) Date of Patent: Aug. 18, 2026

(54) KNITTED COMPONENT WITH CAVITY

(71) Applicant: NIKE, Inc., Beaverton, OR (US)

(72) Inventors: Juan L Aceves Tinajero, Beaverton, OR (US); William P. Halligan, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 62 days.

(21) Appl. No.: 18/339,575

(22) Filed: Jun. 22, 2023

(65) Prior Publication Data

US 2023/0340707 A1 Oct. 26, 2023

Related U.S. Application Data

(63) Continuation of application No. 17/082,537, filed on Oct. 28, 2020, now Pat. No. 11,725,311, which is a continuation of application No. 15/875,821, filed on Jan. 19, 2018, now Pat. No. 10,851,482.

(51) Int. Cl.
*D04B 1/10* (2006.01)
*D04B 1/24* (2006.01)

(52) U.S. Cl.
CPC ..... *D04B 1/102* (2013.01); *D04B 1/24* (2013.01); *D10B 2501/043* (2013.01)

(58) Field of Classification Search
CPC ..... D04B 1/24; D04B 1/102; D04B 1/123; D04B 7/24; D04B 7/14; D04B 7/28; D04B 9/16; A43B 1/04; A43B 23/025
See application file for complete search history.

(56) References Cited

U.S. PATENT DOCUMENTS

| | | | |
|---|---|---|---|
| 2,054,059 | A | 9/1936 | Longtin |
| 2,946,211 | A | 7/1960 | Morancy |
| 3,487,662 | A | 1/1970 | Safrit et al. |
| 6,082,145 | A | 7/2000 | Lonati et al. |
| 6,089,052 | A | 7/2000 | Riegger |
| 6,871,515 | B1 | 3/2005 | Starbuck et al. |
| 9,375,046 | B2 | 6/2016 | Meir |
| 10,851,482 | B2 | 12/2020 | Aceves Tinajero et al. |

(Continued)

FOREIGN PATENT DOCUMENTS

| | | | |
|---|---|---|---|
| CN | 2707786 | Y | 7/2005 |
| CN | 1681984 | A | 10/2005 |

(Continued)

OTHER PUBLICATIONS

Extended European Search Report received for European Application No. 24211796.8, mailed on Nov. 25, 2024, 8 pages.

(Continued)

*Primary Examiner* — Danny Worrell
(74) *Attorney, Agent, or Firm* — Shook, Hardy & Bacon L.L.P.

(57) ABSTRACT

A knitted component may include a course of a first yarn type and a course of a second yarn type, a first surface at least partially formed by the course of the first yarn type, and a cavity formed within the knitted component that is recessed relative to the first surface. A first float formed by the course of the second yarn type may extend across the cavity and may be exposed, and the course of the second yarn type may include a stitch that is knitted into the knitted component adjacent the float.

20 Claims, 7 Drawing Sheets

(56) References Cited

U.S. PATENT DOCUMENTS

| | | | | |
|---|---|---|---|---|
| 11,725,311 | B2 * | 8/2023 | Aceves Tinajero .... | D04B 1/102 66/170 |
| 2006/0281382 | A1 | 12/2006 | Karayianni et al. | |
| 2012/0233882 | A1 | 9/2012 | Huffa et al. | |
| 2016/0251782 | A1 | 9/2016 | Liao et al. | |
| 2018/0353345 | A1 | 12/2018 | Sasaki | |
| 2019/0116914 | A1 | 4/2019 | Schoppel et al. | |
| 2019/0223540 | A1 | 7/2019 | Cox et al. | |
| 2019/0223556 | A1 | 7/2019 | Aceves Tinajero et al. | |
| 2019/0226128 | A1 | 7/2019 | Cox et al. | |
| 2020/0121019 | A1 | 4/2020 | Bartys et al. | |
| 2021/0040657 | A1 | 2/2021 | Aceves Tinajero et al. | |

FOREIGN PATENT DOCUMENTS

| | | | |
|---|---|---|---|
| CN | 101254032 | A | 9/2008 |
| CN | 203828164 | U | 9/2014 |
| CN | 105714463 | A | 6/2016 |
| CN | 106460263 | A | 2/2017 |
| JP | 3215401 | B1 | 10/2001 |
| JP | 2008-038259 | A | 2/2008 |
| WO | 2014/085205 | A1 | 6/2014 |
| WO | 2017/085205 | A1 | 5/2017 |
| WO | 2017/199520 | A1 | 11/2017 |

OTHER PUBLICATIONS

Office Action received for European Application No. 24211796.8, mailed on Feb. 19, 2026, 6 pages.

* cited by examiner

KNITTED COMPONENT WITH CAVITY

CROSS-REFERENCE TO RELATED APPLICATIONS

This application is a continuation of U.S. application Ser. No. 17/082,537, filed Oct. 28, 2020, which is a continuation of U.S. application Ser. No. 15/875,821, filed Jan. 19, 2018, and issued as U.S. Pat. No. 10,851,482, each of which is incorporated by reference herein in its entirety.

BACKGROUND

The present disclosure relates generally to knitted components and methods of manufacturing knitted components, for example, knitted components for use in footwear applications.

SUMMARY

A knitted component may include a course of a first yarn type and a course of a second yarn type, a first surface at least partially formed by the course of the first yarn type, and a cavity formed within the knitted component that is recessed relative to the first surface. A first float formed by the course of the second yarn type may extend across the cavity and may be exposed, and the course of the second yarn type may include a stitch that is knitted into the knitted component adjacent the float. The first surface may correspond with an outermost surface of the knitted component. The cavity may have a depth between 1 mm and 5 mm, inclusive, and may have a width between 2 mm and 10 mm, inclusive. The first float may be recessed relative to the first surface. The course of the second yarn type may further include a second stitch, which may be knitted into the knitted component on an opposite side of the cavity. The first surface may conceal the stitch of the course of the second yarn type from the perspective facing the first surface. The first yarn type may have at least one different visual property than the second yarn type. The second yarn type may include a thermoplastic polymer material. The course of the second yarn type may further include a second float having a length different than the length of the first float.

In another aspect, an upper may include a knit layer at least partially formed by a course of a first yarn type and having multi-bed construction. The knit layer may include a first surface, a cavity formed within the knit layer that is recessed relative to the first surface, and a first course of a second yarn type that may include a first knit stitch and a first float that extends across the cavity, wherein the first knit stitch may be integrally knit with the knit layer. The first float may have a first length and may be exposed, e.g., from a viewing perspective facing the first surface. The first course of the second yarn type may extend from a medial region to a lateral region, and may extend from one of the medial region and the lateral region to a throat region. The upper may further include a second course of the second yarn type that may include a second float that extends across a second cavity. The second course of the second yarn type may be spaced apart from the first course of the second yarn type by a first distance that is at least 5 mm. The second float may have a second length. The upper may further include a third course and a fourth course of the second yarn type that are spaced apart from each other by a second distance. The first and second courses of the second yarn type may be located in a first region of the upper and the third and fourth courses of the second yarn type may be located in a second region of the upper. The upper may further include a sole structure that is secured to the knit layer.

In another aspect, a method of forming a knitted component may include forming a portion of a knit layer by knitting a course of a first yarn type on a first needle bed and a second needle bed, forming a cavity in the knit layer by transferring a plurality of stitches of the course of the first yarn type from the first needle bed to the second needle bed, and knitting a stitch of a second yarn type with the course of the first yarn type and forming a float of the course of the second yarn type that extends across the cavity, which may be recessed relative to a first surface of the knit layer.

Other systems, methods, features and advantages of the present disclosure will be, or will become, apparent to one with skill in the art upon examination of the following figures and detailed description. It is intended that all such additional systems, methods, features and advantages be within the scope of the present disclosure, and be encompassed by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like referenced numerals designate corresponding parts throughout the different views.

The drawings described herein are for illustration purposes only and are not intended to limit the scope of the present disclosure in any way.

DETAILED DESCRIPTION

Figure 1:
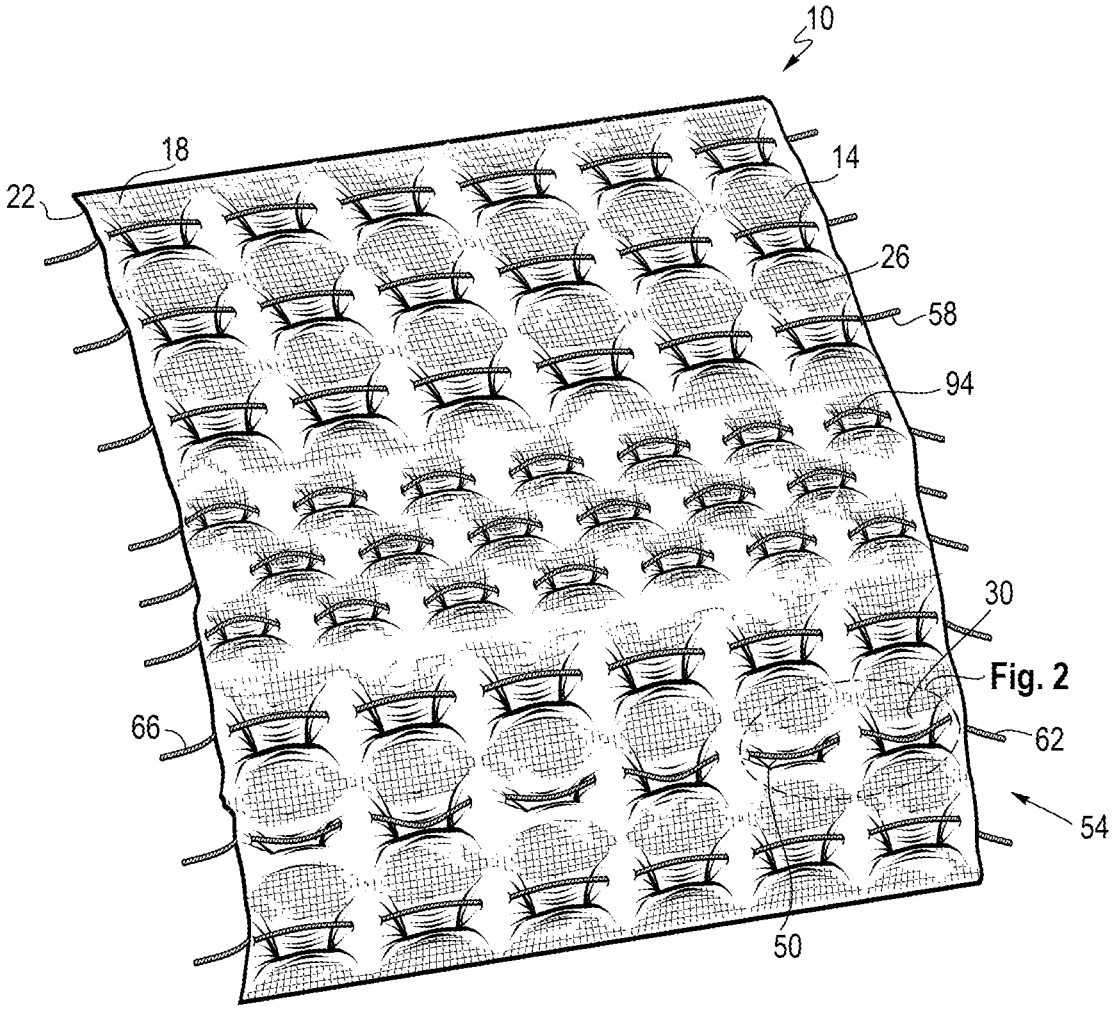
FIG. 1 is a sectional view of a knitted component according to one aspect of the present disclosure.
Figure 2:
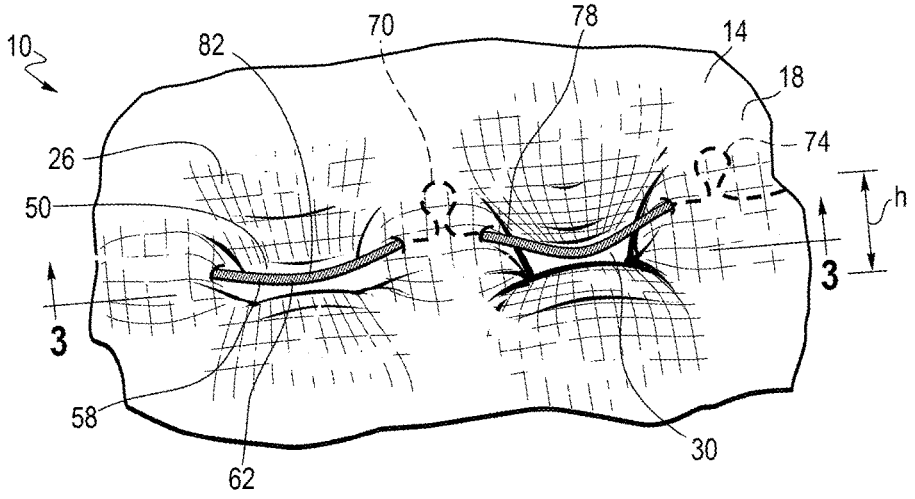
FIG. 2 is an expanded sectional view that shows another aspect of the knitted component of FIG. 1.
Figure 3:
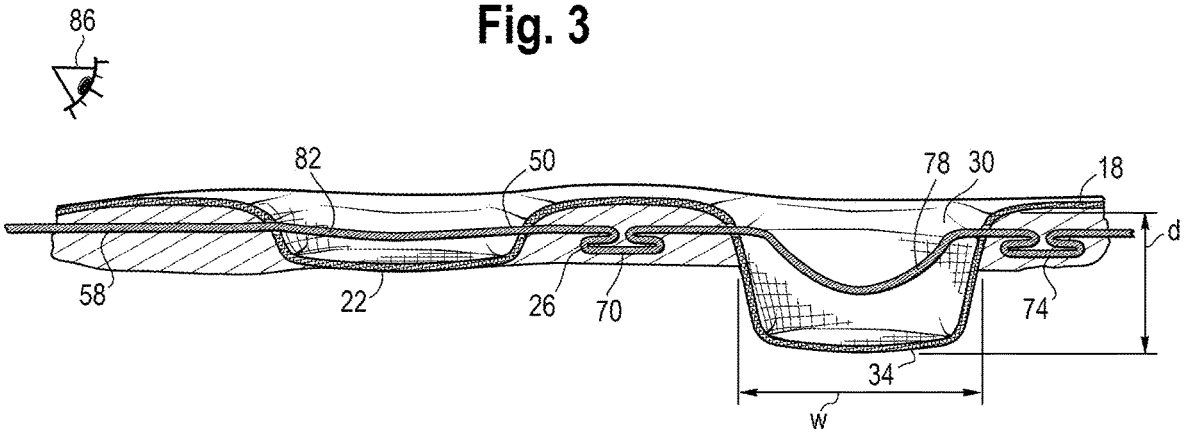
FIG. 3 is a cross-sectional view that shows another aspect of the knitted component of FIG. 1.

Referring to FIGS. 1-3, a knitted component 10 suitable for a number of applications, e.g., footwear and apparel, may be formed as an integral one-piece element from a single knitting process, such as a weft knitting process (e.g., with a flat knitting machine with one, two, or more needle beds, or with a circular knitting machine), a warp knitting process, or any other suitable knitting process. That is, a knitting process on a knitting machine may substantially form the knit structure of knitted component 10 without the need for significant post-knitting processes or steps. Alternatively, two or more portions of knitted component 10 may be formed separately as distinct integral one-piece elements, and then the respective elements may be attached.

Knitted component 10 may include at least a first layer 14 formed on one or more needle beds, e.g., a first needle bed and/or a second needle bed. The knitted component 10 may optionally include one or more additional knit layers that may overlap and may be coterminous in one or more dimensions with first layer 14, e.g., to add cushioning, protection, or for other advantage. When the first layer 14 is formed on more than one needle bed, or when the knitted component 10 includes one or more additional layers that are formed on a different needle bed than the first layer 14, then the resulting knitted component 10 has multi-bed knit construction. As used in this application, a first layer may form a first surface comprising a first plurality of knit loops, and second layer may form a second surface comprising a second plurality of knit loops. In embodiments with more than one layer, the first layer may overlap at least a portion of a second layer, and the first and second layers may be coterminous in one or more dimensions; however, the first and second layers need not be coterminous. At least a portion of the first layer may be freely separable from the second layer. In other words, the first layer and second layer may have opposite facing surfaces, thereby making at least a portion of the first layer freely separable from second layer. That is, the first layer may have a first surface generally facing a first direction, and a second surface generally facing the opposite direction. Likewise for the second area. Although the first layer may be freely separable from the second layer in certain areas, it need not be freely separable. For example, the knitted component may include one or more interlayer knit stitches (e.g., stitches formed between a first needle bed and a second needle bed). Such interlayer knit stitches may be formed by the same yarn(s) that forms the first and/or second layers, or a different yarn. A single course of material may form at least a portion of both first layer and second layer, e.g., a knit structure formed on both first and second needle beds that includes a first plurality of knit loops on the first surface and a second plurality of loops on the second surface. For example, in an interlock knit structure or similar structure with each course having loops formed on a first and a second needle bed, each course may form part of the first and second layers. Alternatively, different courses of material may form first and second layers, e.g., a first course may form a single jersey first layer on a first needle bed and a second course may form a single jersey second layer on a second needle bed. In other embodiments, the knitted component may include additional layers, e.g., to add cushioning, protection, or for other advantage. In various applications, the first layer or second layer may correspond with an outer or inner layer of an article of apparel or industrial textile, an exterior or interior layer of an upper for an article of footwear, or an exterior or interior layer of a component or product used in another application.

In FIGS. 1-3, first layer 14 may have a first surface 18 and a second surface 22. First surface 18 may eventually correspond with an outer or inner layer of an article of apparel, an exterior or interior layer of an upper for an article of footwear, or other application. As first surface 18 may correspond with an outer or an inner surface of knitted component 10, features of knitted component 10 that do not form part of the outer or inner surface may not form part of first surface 18, even if formed by the same material(s) that form first surface 18. For example, one or more cavities in knitted component 10 (described below) may be at least partially formed from the same material(s) that form first surface 18, but the cavities themselves may not form part of first surface 18, e.g., because they are set back relative to the outer or inner surfaces. Thus, first surface 18 may be a reference point for other features of knitted component 10.

The first surface 18 may be at least partially formed by a first yarn type 26. The first surface 18 may include additional materials in addition to the first yarn type 26. While first surface 18 may be at least partially formed of courses of first yarn type 26, not all courses of first yarn type 26, or even all of a single course of first yarn type 26, necessarily form part of first surface 18. Consistent with the preceding paragraph, one or more courses of first yarn type 26 may form aspects of knitted component 10 that are recessed relative to first surface 18. First yarn type 26 may be selected for different applications. For example, first yarn type 26 may be selected for durability, e.g., yarns with tensile strength ranging from approximately 0.4 kg-f to approximately 3.0 kg-f. Additionally or alternatively, first yarn type 26 may have moderate stretch, e.g., yarns or strands (including elasticized yarns or strands) with approximately 20 percent to approximately 50 percent maximum elongation. Additionally, first yarn type 26 may be weatherized, such as yarns or strands having water repellent or resistant properties (e.g., due to a durable water repellent coating). These examples are non-limiting and are intended to illustrate the versatility of first yarn type 26, which may be selected to provide advantageous properties to one or more layers, portions, areas and/or regions of a knitted component.

Figure 4:
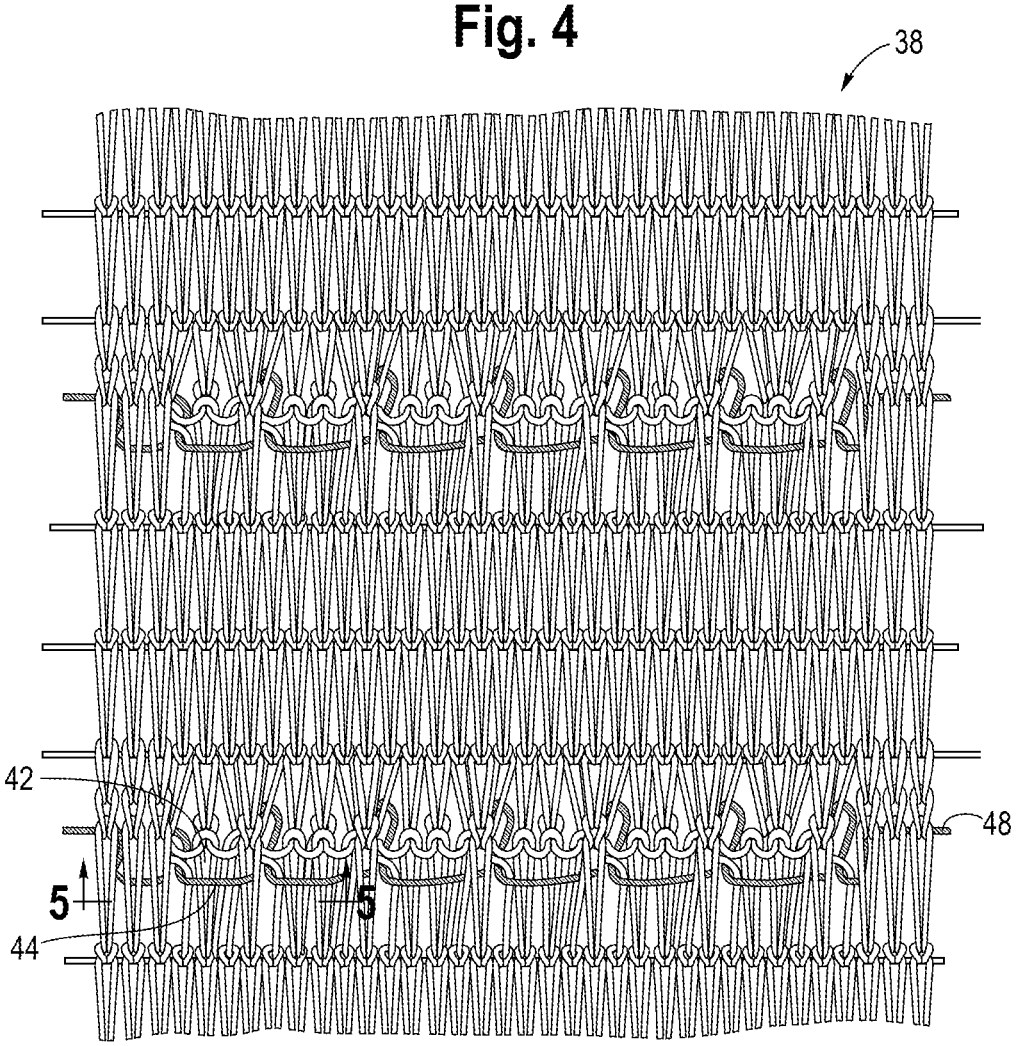
FIG. 4 is a sectional view of another knitted component according to another aspect of the present disclosure.
Figure 5:
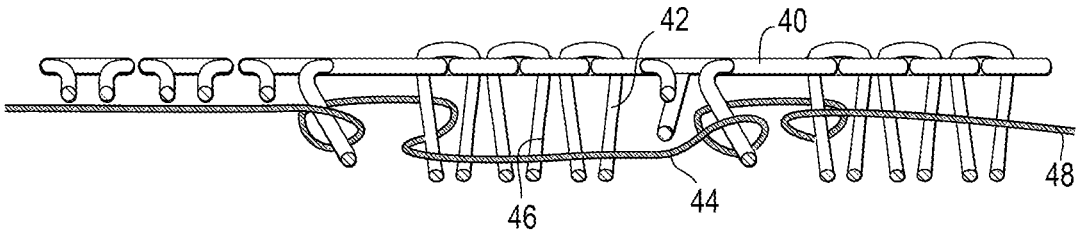
FIG. 5 is a cross-sectional view that shows another aspect of the knitted component of FIG. 4.

Referring still to FIGS. 1-3, first layer 14 may include one or more cavities (e.g., cavity 30) that are recessed relative to first surface 18 and may be formed anywhere upon or within first layer 14. The cavities may protect other aspects of knitted component 10. Not all cavities necessarily have the same characteristics. Cavity 30 has the appearance of a depression having a depth, d, relative to first surface 18, although in other embodiments, cavities may resemble a recess, blind hole, dent, slot, or similar feature with depth relative to first surface 18, and may have a shape that is approximately square, rectangular, elliptical, hyperbolic, or irregular. Cavity 30 has a cavity surface 34 that generally corresponds with the extent of its depth. That is, the maximum depth of cavity 30 generally corresponds with the extent to which cavity surface 34 is recessed relative to first surface 18, and may be at least 1 mm, and may range from approximately 1 mm to approximately 10 mm, e.g., between 1 mm and 5 mm, inclusive. Generally, the depth within a single cavity may vary. For example, cavity surface 34 is contoured, and as a result cavity 30 has a minimum depth around its perimeter, and a maximum depth near the middle. In the alternative embodiment of FIGS. 4-5, a knit component 38 includes a first surface 40 and a cavity 42 having a sloped cavity surface 46. Consequently, the depth of cavity 42 is zero at one side of cavity 42 and gradually increases to a maximum depth at another side. A float 44 of a course 48 of a second yarn type extends across cavity 42 and interloops with knitted component 38 on either side of cavity 42. In other embodiments, cavity surfaces may be flat, contoured, or have another profile. Referring again to FIGS. 1-3, cavity 30 has a height, h, ranging from approximately 3 mm to approximately 10 mm or greater. Cavity 30 also has a width, w, that may be at least 2 mm, and may range from approximately 2 mm to approximately 20 mm or greater, e.g., between 2 mm and 5 mm, inclusive. Any of the foregoing dimensions may vary between cavities in the same or different embodiments. For example, knit component 10 also includes cavity 50, which has a different depth than cavity 30.

Knitted component 10 includes a plurality 54 of cavities (e.g., cavities 30, 50) that extend in a course-wise direction (e.g., a single course of first yarn type 26 forms at least part of more than one cavity) and in a wale-wise direction (e.g., the plurality 54 is formed by more than one course of first yarn type 26), forming a pattern. Along a single course of first yarn type 26 or between courses of first yarn type 26, each cavity of the plurality 54 may have the same or different dimensions (i.e., depth, width, and height). In other embodiments, pluralities of cavities may form different patterns, e.g., patterns that extend diagonally relative to one or more edges of the knitted component, patterns that form geometric or irregular groups of cavities, etc.

As noted above, cavities may protect other aspects of knitted component 10. In particular, each cavity (e.g., cavity 30) may protect one or more portions of a course of a second yarn type 58 (such as floats) that extend across the cavity when knitted as described below. Second yarn type 58 may be selected to have relatively high tensile strength in order to impart additional strength and stretch resistance to knitted component 10. Alternatively, second yarn type 58 may be knitted to have a relatively high degree of elasticity in order to impart resiliency to knitted component 10. Additionally or alternatively, second yarn type 58 may be selected to have one or more different visual properties relative to first yarn type 26 or another useful property, e.g., reflectivity, a different color, a different texture, or other visual property. For example, suitable material for second yarn type 58 may include thermoplastic polymer yarns such as a reflective thermoplastic polyurethane yarn, multi-filament polyester yarns, monofilament strands, etc. Such yarns may be coated or treated to prevent fibrillation during the knitting process.

Knitted component 10 contains a plurality of courses of second yarn type 58 (e.g., a first course 62 and a second course 66), each of which may be parallel to one or more other courses of second yarn type 58. In some embodiments, the knitted component may include a first and second course of second yarn type that are spaced apart by a first distance (e.g., 5-10 mm), and may also contain third and fourth course that are spaced apart by a second distance, which may be the same or different from the first distance (e.g., 10-20 mm). In FIGS. 1-3, first course 62 and second course 66 are located near each other (in the same region of knitted component 10), although in other embodiments, courses of second yarn type 58 may be located in different regions of the knitted component. If the knitted component includes one or more gores or wedges (not shown), then it is possible for courses of second yarn type 58 to have non-parallel orientations.

Referring still to FIGS. 1-3, courses of second yarn type 62, 66 are knitted into knitted component 10, i.e., interlooped with one or more other courses that form knitted component 10. Referring to FIG. 2 for example, course 62 of second yarn type 58 may include at least one stitch, for example first stitch 70 and second stitch 74 (shown in hidden lines), that is integrally knitted with one or more courses of first yarn type 26. Advantageously, knitting one or more courses of second yarn type 58 into knit component 10 fixes the course-wise position of at least a portion of that course. By comparison, an inlaid course of second yarn type 58 (without stitches), would be vulnerable to translating within the knitted component in course-wise directions. Stitches 70, 74 are adjacent to floats 78, 82 that are free of knit stitches as a result of skipping one or more needles. Each course of second yarn type 58 may alternate between stitches and floats, such that one or more floats is bounded by stitches. Each stitch of each course of second yarn type 58 (e.g., stitches 70, 74) may be formed on one or more needle beds, e.g., a first needle bed or a second needle bed. Forming stitches on the second needle bed with a float in between may cause the float to be recessed relative to the first surface, and may further cause the stitches to be concealed from a viewpoint facing first surface 18. For example, stitches 70, 74 may be formed on a second needle bed, and therefore are concealed from a viewpoint 86 facing first surface 18.

Each float of second yarn type 58 (e.g., floats 78, 82) may have a float length that may be characterized as the distance along the float between bounding stitches or by the number of needles skipped. For example, float 78 has a float length that corresponds to the distance along float 78 between stitches 70, 74. Generally, the float length may range from two to ten needles or a greater number of needles, e.g., three, four, or five needles. Referring to FIG. 3, floats may have a straight appearance (e.g., if taut) or a U-shaped appearance (e.g., if the float has slack and/or is not under tension). A straight float such as float 82 of FIGS. 1, 3 may advantageously increase the stretch resistance of the knitted component because it limits mechanical stretch (as compared to a knit stitch or a U-shaped float, which may allow mechanical stretch, i.e., straightening of the course due to application of a tensile force). However, a U-shaped float (such as float 78) may also have advantages; for example, float 78 may nest within cavity 30, where it is protected from snagging. More than one float may exist along a single course of second yarn type 58, and those floats may have different float lengths. For example, course 62 includes floats 78 (with a first float length that is longer because it is U-shaped) and 82 (with a second, shorter float length because it is straight).

The cavities may protect the floats. For example, one or more floats (e.g., float 78) extends across each cavity (e.g., cavity 30). In other words, float 78 may pass across the void created by cavity 30 such that it is suspended above, or rests on, cavity surface 34. This structure has at least two characteristics. First, float 78 may be exposed and visible from viewpoint 86. This feature may reveal and accentuate the visual properties of second yarn type 58, e.g., reflectivity or contrasting color. At the same time, because cavity 30 may not extend all the way through knitted component 10, float 78 may not be visible from all viewpoints (e.g., a viewpoint facing second surface 22). Although float 78 may be visible, stitches 70, 74 of may not be visible from viewpoint 86, especially if knitted on a needle bed other than the needle bed that formed the stitches that predominantly make up first surface 18. In other embodiments, more than one float may extend across each cavity.

Another characteristic of this knit structure is that a float may potentially form part of first surface 18 if it is substantially coplanar with first surface 18 (e.g., coplanar with stitches of first yarn type 26 that form at least part of first surface 18); this may occur if a float protrudes from a cavity (e.g., float 94 of FIG. 1). Alternatively, a float may be recessed relative to first surface 18 by a distance that is less than the maximum depth of the cavity in which it resides. For example, float 78 is recessed relative to first surface 18 because it resides within cavity 30. Advantageously, by knitting a float that extends across a cavity and is recessed relative to first surface 18, that float may be visible from viewpoint 86, yet protected. This feature may be useful regardless of whether second yarn type 58 has high durability, because an exposed float may be prone to snagging and breakage. A float may be further recessed within a cavity relative to first surface 18 if that float is adjacent to stitches of the same course that are formed on a needle bed other than the needle bed that formed the stitches that predominantly make up first surface 18. For example, first surface 18 includes stitches formed on a front needle bed of a knitting machine, and stitches 78, 82 of course 62 of second yarn type 58 are formed on a rear needle bed; as a result, float 78 may advantageously may be recessed deeper within cavity 30 than if stitches 70, 74 were knitted on the first needle bed. In some embodiments, a float (e.g., float 78) may nest within a cavity, i.e., fit compactly within or "bed down" within the cavity, rather than passing across a cavity in a straight configuration. Knitting slack into a float may accentuate this nested structure.

Figure 6A:
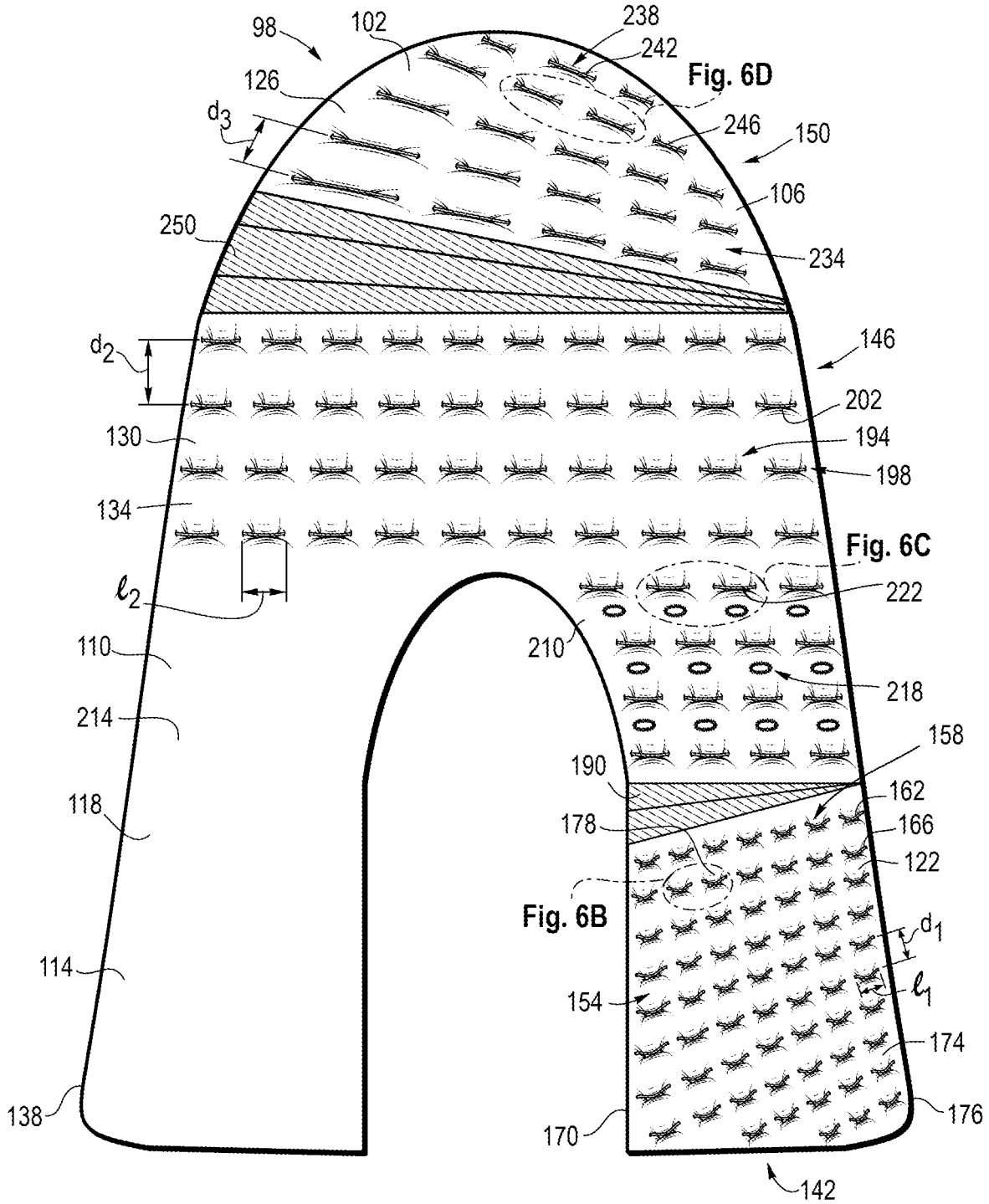
FIG. 6A is a sectional view of an upper component according to one aspect of the present disclosure.

Referring now to FIG. 6A, an upper 98 for an article of footwear includes a knitted component 102 as described above having cavities and floats. Upper 98 resembles a U-shape in FIG. 6A, however, it shall be understood that the "horseshoe"-shape or "U-shape" shape is merely exemplary, and other knitted components embodying the disclosure of this application may be knitted with edges in different locations, for example a "C-shaped" knitted component or a multiple-piece knitted component. For reference purposes, upper 98 may be divided generally along a longitudinal direction (heel-to-toe) into three general regions: a forefoot region 106, a midfoot region 110, and a rearfoot region 114. Forefoot region 106 may generally include portions that may eventually correspond (when incorporated into an article of footwear) with the toes and the joints connecting the metatarsals with the phalanges. Midfoot region 110 may generally include portions corresponding with an arch area of the foot. Rearfoot region 114 may generally correspond with rear portions of the foot, including areas that cover the calcaneus bone (which comprises a portion of a wearer's heel). Additionally, rearfoot region 114 may cover some or all of the wearer's malleoli and talus (which comprise a portion of the ankle). Upper 98 may also include a medial side 118 and a lateral side 122, which may extend through each of forefoot region 106, midfoot region 110, and rearfoot region 114, and may correspond with opposite sides. More particularly, lateral side 122 may correspond with an outside area of the foot (i.e., the surface that faces away from the other foot), and medial side 118 may correspond with an inside area of the foot (i.e., the surface that faces toward the other foot). Forefoot region 106, midfoot region 110, rearfoot region 114, medial side 118, and lateral side 122 are not intended to demarcate precise areas of a knitted component, upper, or article, but rather are intended to represent general areas to aid in the following discussion.

Referring still to FIG. 6A, knitted component 102 includes a first layer 126 having a first surface 130 formed at least partially from a first yarn type 134, and an opposite-facing second surface 138. First surface 130 may correspond with an exterior surface, and second surface 138 may correspond with an interior surface when upper 98 is incorporated into an article of footwear. Knitted component 102 includes a first protected float area 142 located in rearfoot region 114 on lateral side 122, a second protect float area 146 located in midfoot region 110, and a third protected float area 150 located in forefoot region 106. It shall be understood that knit structures present in any protected float area of upper 98 may also be suitable in other protected float areas and in other locations (including other regions and/or sides) of upper 98.

Referring to FIGS. 6A, B, first protected float area 142 includes a first plurality of cavities 154 (e.g., cavity 178) and a first plurality of courses 158 of a second yarn type 162 (e.g., course 166). At least some courses of second yarn type 162 have a diagonal orientation extending from a collar region 170 to a lateral edge region 174 (including a lateral edge 176), and include at least one float and at least one knit stitch (concealed behind first surface 130). At least one float of second yarn type 162 extends across a cavity of the first plurality 154. At least one stitch of the first plurality of courses 158 of second yarn type 162 interloops with one or more courses of knitted component 102 (e.g., may interloop with one or more courses of first yarn type 134), and each stitch may be concealed by first surface 130. At least one float in first protected float area 142 has a relatively short float length $l_1$, and at least two courses of second yarn type 162 are separated by a first distance $d_1$.

Figure 6B:
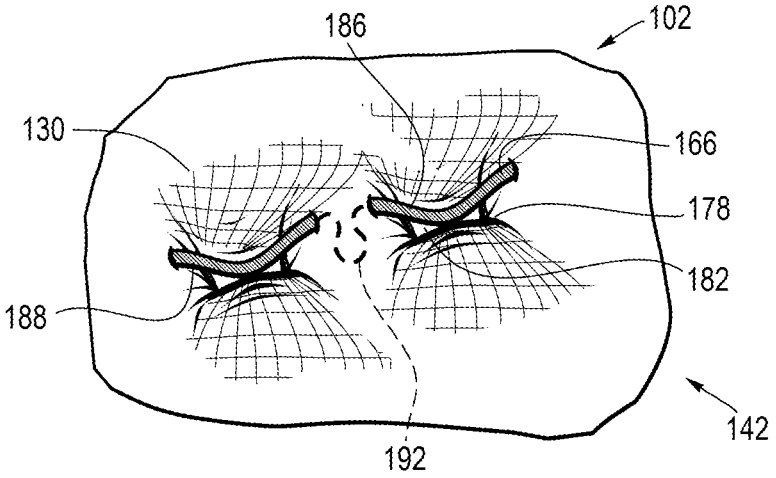
FIG. 6B shows an expanded sectional view of the knit component of FIG. 6A.

Referring to FIGS. 6A-6B, cavity 178 has a depth corresponding to the distance between first surface 130 and first cavity surface 182. U-shaped float 186 of course 188 is nested deeply within cavity 178 (it has slack and fits compactly within cavity 178) at a depth that approaches first cavity surface 182, and thus float 178 may be visibly recessed relative to first surface 130. Course 188 also includes a stitch 192 (concealed behind first surface 130) that interloops with one or more yarns of knitted component 102. Notably, courses of plurality 158 may not be parallel to courses of yarns in second and third protected float areas 146, 150 due to the use of one or more wedges or gores 190 to vary the course-wise direction of knitted component 102 in rearfoot region 114.

Figure 6C:
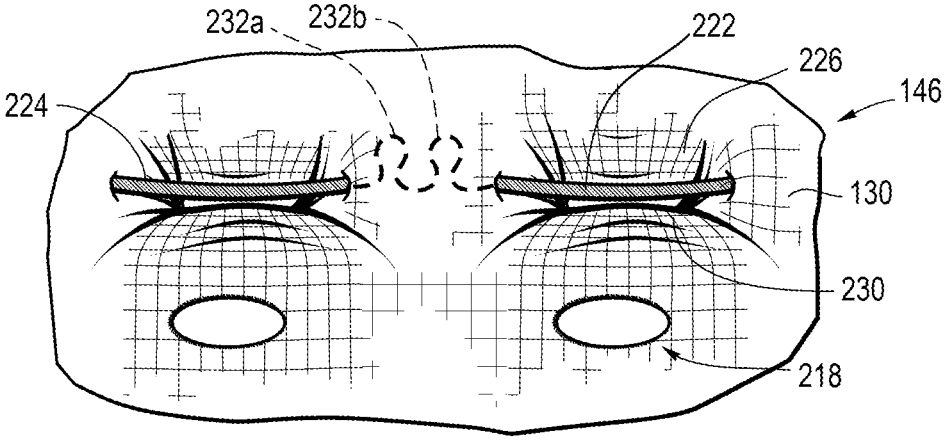
FIG. 6C shows another expanded sectional view of the knit component of FIG. 6A.

Referring to FIGS. 6A, 6C, second protected float area 146 includes a second plurality of cavities 194 formed in knitted component 102, along with a second plurality of courses 198 of a third yarn type 202 selected for high strength and oriented in a medial to lateral direction. At least some courses of third yarn type 202 include at least one float and at least one stitch that is interlooped with knitted component 102. At least some floats in second protected float area 146 have a second float length $l_2$ that is larger than first float length $l_1$ of first protected float area 142. At least some courses of third yarn type 202 in second protected float area 146 area separated from at least one other courses of third yarn type 202 by a second distance $d_2$ that is greater than the first distance $d_1$ of first protected float area 142. At least some courses of third yarn type 202 include one or more stitches that interloop with knitted component 102, thereby affixing the course-wise position of those courses. One or more courses of third yarn type 202 may extend from lateral edge region 174 (including lateral edge 176) to a throat region 210 and/or to a medial edge region 214 (including a medial edge 216). The floats and stitches that may exist in one or more courses of third yarn type 202 may alternate; this characteristic, along with the potential medial-lateral orientation of courses of third yarn type 202, may advantageously inhibit medial-lateral movement of a wearer's foot when upper 98 is incorporated into an article of footwear. Second protected float area 146 also includes a plurality of optional apertures 218 that extend through upper 98 between courses of third yarn type 202. Such apertures may have a number of different sizes and shapes, including elliptical, circular, square, rectangular, etc. Apertures of plurality 218 are exemplary, and may optionally exist in other protected float areas to improve breathability of upper 98, improve visibility through knitted component 102, and/or provide another technical advantage.

Referring to FIGS. 6B, 6C, float 222 of course 224 may extend across a cavity 226 at a depth that is intermediate between first surface 130 and second cavity surface 230, and therefore float 222 may be less recessed relative to first surface 130 than float 186 in first protected float area 142.

Course 224 may include first and second stitches 232*a, b* that interloop with one or more yarns of knitted component 102.

Figure 6D:
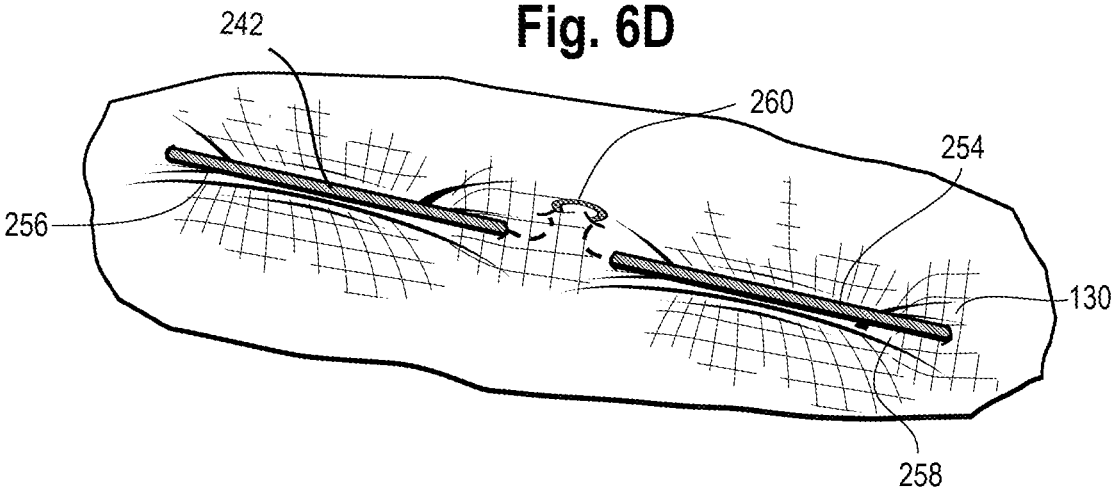
FIG. 6D shows yet another expanded sectional view of the knit component of FIG. 6A.

Referring to FIGS. 6A, 6D, third protected float area 150 includes a third plurality of cavities 234 formed in knitted component 102, along with a third plurality of courses 238 of a fourth yarn type 242. Each course of fourth yarn type 242 includes a plurality of floats, at least some of which may have different float lengths. For example, course 246 includes a plurality of floats, each with a different float length, such that floats nearer to lateral edge region 174 have a shorter float length than floats near to medial edge region 214. However, the variation in float lengths may differ in other embodiments, e.g., by decreasing in the lateral to medial direction, by varying randomly, or in another manner. Courses of fourth yarn type 242 may be separated by one or more distances that may be greater than or less than first distance $d_1$ and second distance $d_2$. Notably, courses of fourth yarn type 242 in third protected float area 150 are not parallel to courses in first or second protected float areas 142, 146 as a result of optional wedges or gores 250 to vary the course-wise direction of knitted component 102. Referring to FIG. 6D, straight float 254 of course 256 may extend across cavity 258 at a depth that approaches first surface 130. Course 256 includes stitch 260 that is interlooped with knitted component 102 and partially exposed through first surface 130.

Figure 7:
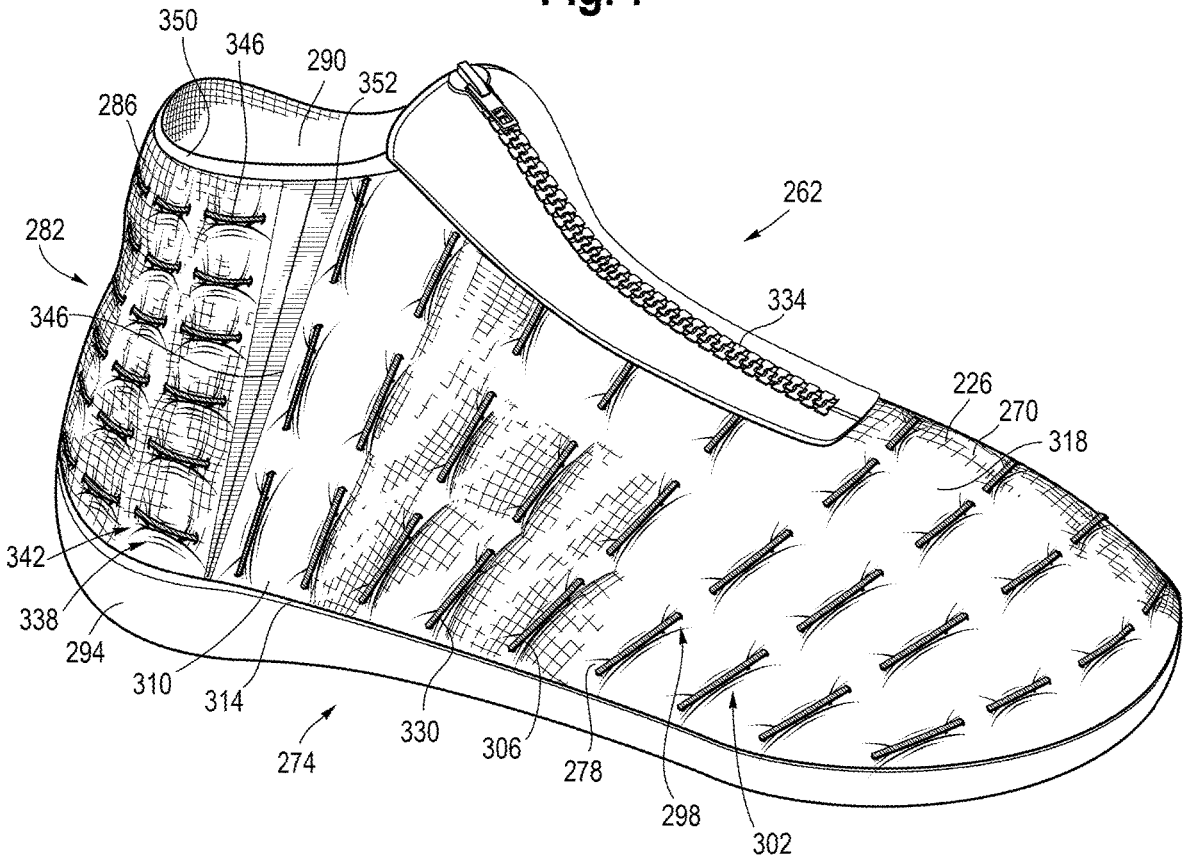
FIG. 7 is a perspective view of an article of footwear according to one aspect of the present disclosure.

In FIG. 7 an article of footwear 262 is shown that incorporates an upper 266 at least partially formed from a knitted component 270 constructed as described above, with a first protected float area 274 in a midfoot region 278 and a second protected float area 282 in a rearfoot region 286. Article 262 has a general configuration suitable for walking or running. Concepts associated with footwear, including the upper and knitted component, may also be applied to a variety of other athletic footwear types, including but not limited to baseball shoes, basketball shoes, cross-training shoes, cycling shoes, football shoes, soccer shoes, sprinting shoes, tennis shoes, and hiking boots. The concepts may also be applied to footwear types that are generally considered to be non-athletic, including dress shoes, loafers, sandals, and work boots. The concepts disclosed herein apply, therefore, to a wide variety of footwear types. Furthermore, the concepts disclosed herein may apply to articles beyond footwear, such as accessories or apparel. In the embodiment of FIG. 7, upper 266 may generally provide a comfortable and secure covering for a wearer's foot. As such, upper 266 may define a void 290 to effectively receive and secure a foot within article 262. Moreover, an optional sole structure 294 may be secured to a lower area of upper 266 and may extend between the foot and the ground to attenuate ground reaction forces (i.e., cushion the foot), provide traction, enhance stability, and influence the motions of the foot.

First protected float area 274 includes a first plurality of cavities 298 formed in knitted component 270 and a first plurality of courses 302 of a second yarn type 306. Each course of second yarn type 306 includes a plurality of floats and knit stitches (concealed) and has a medial-lateral orientation. Some courses of second yarn type 306 may extend at least part-way from a lateral edge region 310 (including a lateral edge 314) at or near sole structure 294, across overfoot portion 318, to a medial edge region (including a medial edge). For example, course 330 extends from sole structure 294 to fastening system 334, which may be a lace, zipper, or similar structure. Course 330 may be secured to sole structure 294 and/or fastening system 334 with adhesive, a thermal bond, with one or more knit stitches, or by other means.

Second protected float area 282 includes a second plurality of cavities 338 and a second plurality of courses 342 of third yarn type 346 that extend in a horizontal direction around rearfoot portion 286 of article 262. Second protected float area 282 may extend to a lateral border region 346 that is adjacent to first protected float area 274, and may also extend from sole structure 294 to a collar region 350. Courses of third yarn type 346 in second protected float area 282 are not parallel to courses of second yarn type 306 first protected float area 274 due to the use of one or more wedges or gores 352.

Figure 8:
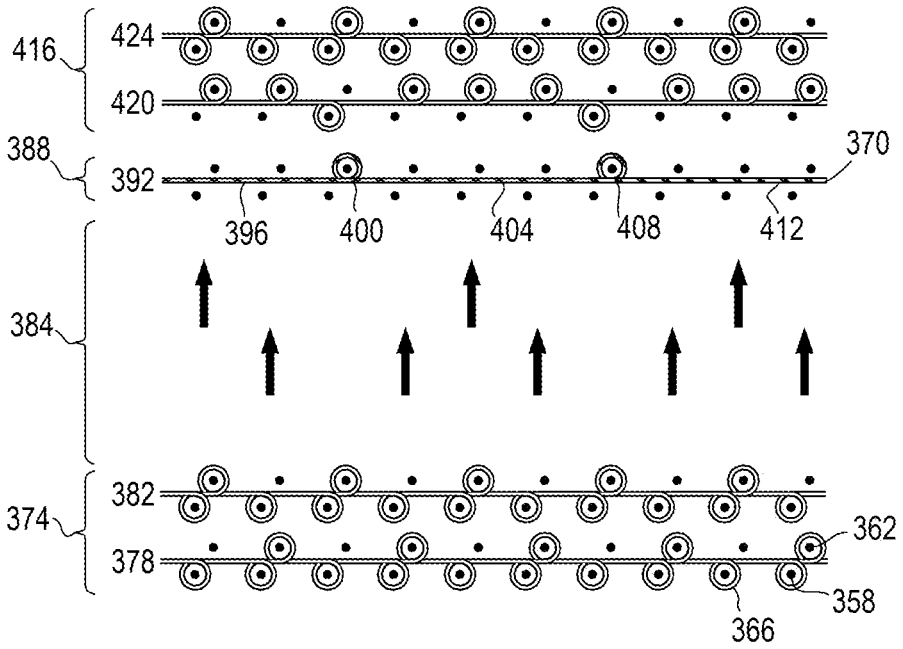
FIG. 8 is a knitting sequence according to one aspect of the present disclosure.

Referring now to FIG. 8 a knitting sequence is illustrated that may be utilized to form integrally-knitted components as described above, such as through a weft knitting process (e.g., with a flat knitting machine with one, two, or more needle beds). The non-limiting sequence of FIG. 8 is illustrated on a weft knitting machine having a first needle bed 358 and a second needle bed 362. The knitting sequence illustrates the formation of a protected float area that utilizes courses of a first yarn type 366 to form a first layer, including a plurality of cavities. The knitting sequence also utilizes courses of a second yarn type 370 that form a plurality of floats extending across the cavities, and knit stitches that interloop with the first layer.

At a first step 374, the knitting machine forms courses 378, 382 of first yarn type 366 on first and second needle beds 358, 362 in order to form a portion of the first layer. In other words, first and second courses 378, 382 have multi-bed construction. Courses 378, 382 may have a number of configurations, such as an interlock structure with less-than-full gauge knitting on both first and second needle beds 358, 362. If courses knitted during step 374 knit a loop of first yarn type 366 on a needle of first needle bed 358, then the corresponding needle on second needle bed 362 may be left free of loops in order to preserve those needles for transfers in a subsequent step.

At a second step 384, the knitting machine forms a plurality of cavities in the knit layer by transferring one or more stitches of courses 378, 382 from first needle bed 358 to second needle bed 362. The cavity width may generally correspond with the number of transferred loops. When forming cavities, the knitting machine may not transfer all loops of courses 378, 382 to second needle bed 362, as those loops that remain on first needle bed 358 may form boundaries of the cavities. Therefore, the knitting machine may leave one, two, three, or more loops of courses 378, 382 on first needle bed 358 in between transferred loops. In FIG. 8, the knitting machine forms three cavities each having a three-needle width by transferring loops of courses 378, 382 from the second, third, fourth, fifth, sixth, eighth, ninth, and tenth needles on first needle bed 358 to opposite needles on the second needle bed 362, leaving loops of courses 378, 382 on the third and seventh needles of first needle bed 358. Following second step 384, the knitting machine will have formed three cavities, each being separated by one stitch.

In a third step 388, the knitting machine knits at least one course 392 of second yarn type 370 on second needle bed 362. Specifically, course 392 includes a first float 396, a first loop 400, a second float 404, a second loop 408, and a third float 412. Each float 396, 404, 412 skips three needles, i.e., has a three-needle float length. Additionally, each float extends across a cavity formed during second step 384. Where first and second loops 400, 408 are formed on second needle bed 362, those loops 400, 408 interloop with loops of course 382 of first yarn type 366 knitted during first step 374. As a result, loops 400, 408 fix the course-wise position of course 392 within the knitted component.

In a fourth step 416, the knitting machine forms courses 420, 424 of first yarn type 366 on first and second needle beds 358, 362 in order to continue forming the first layer, and also to interloop the first layer with course 392 of second yarn type 370. Courses 420, 424 may form one boundary of the cavities formed during second step 384. Following first through fourth steps 374-416, the knitting machine will have formed a multi-bed first layer formed from a first yarn type 366 and having a plurality of cavities that are recessed relative to a first surface, with a float of a second yarn type 370 extending across each cavity, and with at least one stitch of a course of the second yarn type 370 interlooped with the first layer.

Structures and methods described herein may produce knitted components have numerous advantages, including a plurality of protected floats that are visible from a viewpoint facing a first surface. The plurality of floats are protected by virtue of extending across one or more cavities formed in a first layer. Each cavity allows one or more floats to fit compactly or nest within it, to extend across it in a straight configuration, or to protrude outward from it. Additionally, the floats may have a different visual property than other materials utilized in the first surface; because the floats may be visible, yet protected, the different visual property may create an attractive appearance. Additionally, the floats may increase stretch resistance and strength of the knitted component, especially in the course-wise direction.

While various embodiments of the present disclosure have been described, the present disclosure is not to be restricted except in light of the attached claims and their equivalents. Rather, the embodiments discussed were chosen and described to provide the best illustration of the principles of the present disclosure and its practical application to thereby enable one of ordinary skill in the art to utilize the present disclosure in various forms and with various modifications as are suited to the particular use contemplated. It is intended and will be appreciated that embodiments may be variously combined or separated without departing from the present disclosure and all exemplary features described herein are applicable to all aspects of the present disclosure described herein. Moreover, the advantages described herein are not necessarily the only advantages of the present disclosure and it is not necessarily expected that every embodiment of the present disclosure will achieve all of the advantages described.

We claim:

1. A knitted component, comprising:
a first course of a first yarn type;
a second course of a second yarn type;
a first surface at least partially formed by the first course of the first yarn type; and
a cavity formed within the knitted component,
wherein the cavity is recessed relative to the first surface, and
wherein the cavity has a depth that gradually and continuously increases from a first side of the cavity to an opposite second side of the cavity.

2. The knitted component of claim 1, further comprising:
a first float formed by the second course of the second yarn type that extends across the cavity and is exposed.

3. The knitted component of claim 2, wherein the first float is recessed relative to the first surface.

4. The knitted component of claim 2, wherein the second yarn type comprises a thermoplastic polymer material.

5. The knitted component of claim 2, wherein the second yarn type has a tensile strength between 0.4 kg-f and 3.0 kg-f, inclusive.

6. The knitted component of claim 2, wherein the second yarn type has an elongation between 20% and 50%, inclusive.

7. The knitted component of claim 2, wherein the second yarn type comprises a water-repellant coating.

8. The knitted component of claim 1, wherein the first surface is an outermost surface of the knitted component.

9. The knitted component of claim 1, wherein the depth of the cavity is zero at the first side of the cavity and increases to a maximum depth at the second side of the cavity.

10. The knitted component of claim 9, wherein the maximum depth is between 1 mm and 5 mm, inclusive.

11. The knitted component of claim 1, wherein the depth of the cavity increases gradually and continuously in a course-wise direction of the knitted component.

12. The knitted component of claim 1, wherein the depth of the cavity increases gradually and continuously in a wale-wise direction of the knitted component.

13. An article of footwear comprising an upper at least partially formed from the knitted component of claim 1.

14. A knitted component, comprising:
a first surface at least partially formed from a first course of a first yarn type;
a second course of a second yarn type;
a first cavity formed within the knitted component,
wherein the first cavity is recessed relative to the first surface,
and
wherein the first cavity has a first depth that gradually and continuously increases from a first side of the first cavity to a first maximum depth on an opposite second side of the first cavity; and
a second cavity formed within the knitted component,
wherein the second cavity is recessed relative to the first surface,
and
wherein the second cavity has a second depth that gradually and continuously increases from a first side of the second cavity to a second maximum depth on an opposite second side of the second cavity,
wherein the first cavity and the second cavity each comprise a recessed cavity surface defined within the knitted component.

15. The knitted component of claim 14, wherein the second maximum depth is greater than the first maximum depth.

16. The knitted component of claim 14, further comprising:
a first float formed by the second course of the second yarn type that extends across the first cavity and is exposed; and
a second float formed by a course of the second yarn type that extends across the second cavity and is exposed.

17. The knitted component of claim 14, wherein the first cavity has a depth of zero at the first side of the first cavity, and wherein the second cavity has a depth of zero at the first side of the second cavity.

18. An article of footwear comprising an upper at least partially formed from the knitted component of claim 14.

19. An article of footwear, comprising:
an upper, comprising:
a knitted component, comprising:
a plurality of courses forming at least part of an outer-facing surface of the upper; and a cavity comprising a recessed cavity surface defined within the knitted component, wherein the cavity is sloped such that a depth of the cavity increases gradually and continuously from a first side of the cavity to an opposite second side of the cavity.

20. The article of footwear of claim 19, wherein the depth of the cavity is zero at the first side of the cavity and is a maximum depth at the second side of the cavity.

* * * * *